United States Patent [19]

Blanke

[11] Patent Number: 4,981,258

[45] Date of Patent: Jan. 1, 1991

[54] BOX CONSTRUCTION

[76] Inventor: L. Carl Blanke, 330-33rd St., N.W., Canton, Ohio 44709

[21] Appl. No.: 434,768

[22] Filed: Nov. 13, 1989

[51] Int. Cl.[5] ..... B65D 5/42

[52] U.S. Cl. ..... 229/198.3; 229/DIG. 2

[58] Field of Search ..... 229/125, 39, 198, 198.3, 229/23 R, DIG. 2, DIG. 4; 190/126; 112/401, 405, 440, 441; 493/118, 119, 121

[56] References Cited

U.S. PATENT DOCUMENTS

| | | | |
|---|---|---|---|
| 7,155 | 6/1876 | Drake | 112/440 |
| 619,998 | 2/1899 | Saunders | 112/440 |
| 1,393,273 | 10/1921 | Elliott | 190/126 |
| 1,433,281 | 10/1922 | Hubard | 229/48 R |
| 1,449,467 | 3/1923 | Walter | 229/48 R |
| 1,513,709 | 10/1924 | Letzkus | 112/401 |
| 2,179,963 | 7/1939 | Thomson | 112/440 |
| 2,281,854 | 5/1942 | Miller, Jr. | 229/48 R |
| 2,372,632 | 3/1945 | Webb | 229/48 R |
| 2,487,951 | 11/1949 | Stein | 190/126 |
| 3,275,216 | 9/1966 | Collins | 229/37 R |
| 3,908,571 | 9/1975 | Motsenbocker | 112/441 |

FOREIGN PATENT DOCUMENTS

| | | | |
|---|---|---|---|
| 177370 | 1/1954 | Austria | 229/47 |

OTHER PUBLICATIONS

Distribution Packaging, 1977, pp. 107, 108.

*Primary Examiner*—Gary E. Elkins
*Attorney, Agent, or Firm*—Frease & Bishop

[57] ABSTRACT

A new lap joint is provided for fibreboard box construction having maximum strength and minimum cost, as compared with stapled, glued or taped joints long used in the manufacture of fibreboard boxes. The new lap joint construction involves thread-sewing lapped portions of a typical fibreboard cut flat, that is, a panel end portion at one end of the flat and a tab projecting from the other end of the flat are overlapped and sewn to form the joint. This new lap joint construction eliminates problems and avoids defects which long have existed in the art.

1 Claim, 1 Drawing Sheet

BOX CONSTRUCTION

BACKGROUND OF THE INVENTION

1. Field of the Invention

The present invention relates to the construction of fiberboard boxes and more particularly the invention relates to a new joint construction for the manufacture of fiberboard boxes. The fiberboard may be the most commonly used of corrugated fiberboard or a solid fiberboard having sufficient thickness and strength characteristics to satisfy the strength values required for a container.

2. Description of the Prior Art

Fiberboard boxes or containers and more particularly corrugated fiberboard boxes or containers have been constructed in a wide variety of configurations and forms. A very common type of construction consists of a flat box panel which includes a plurality of side panels and corresponding end panels or flaps and a tab extending from one of the end panels which is adapted to be joined to the corresponding side panel when the flat blank is folded into a box configuration. The joint tab is joined to the side panel by what is known in the trade as a "manufacturer's joint". In the employment of this joint, the two ends of the finished box blank are brought together and permanently fastened with glue tape, or adhesive, or wire staples. The tab which forms the joint may be an extension of either the end panel which is fastened to a side panel, or it may be an extension of the side panel which is fastened to an end panel. The tab may also be fastened either inside or outside of the adjoining panel.

The manufacturer's joint, when made with wire staples, is commonly referred to as a "stitched joint". Each of these prior art constructions has certain inherent disadvantages. When a stitched joint is employed, the wire staples project slightly into the box from the inner surface of the fiberboard to an extent where the staples may scratch, mar or otherwise injure objects contained in the box, unless the staples are coated, covered or otherwise protected. Such protective coating and its inclusion in the box construction obviously increases the cost of fiberboard box manufacture. Such stitched joints, however, are strong and have maximum strength as compared with other types of joints. Stitched joints also have a further disadvantage in that the staples are normally manufactured from steel and, therefore, are subject to rusting which, under adverse conditions, could damage the contents of the container.

Taped joints, which are not lap joints, do not include a tab, have been commonly used in fiberboard box construction. In such constructions the edge of a side panel is butted to the edge of an end panel, and a length of glue tape is applied to the butted edges throughout the joint's length. Not only does a tape joint require tape having a special glue, but the joint is normally weaker and is further subject to joint deterioration in the presence of moisture.

The third type of joint referred to, a glued joint, is constructed by gluing the tab projecting from one of the box panels to the adjacent panel.

Although glued joints are cheaper to manufacture than stapled or taped joints, a glued joint can come apart because of the insufficient application of glue, or because of the use of the wrong type of glue, and more particularly such joints can be severely weakened in the presence of an excess amount of moisture. Numerous other types of joints have been proposed in the manufacture of fiberboard boxes, and many of those are discussed in my earlier filed application, Ser. No. 570,033, filed Jan. 11, 1984, entitled BOX CONSTRUCTION, now abandoned.

None of the prior art patents, of which I am aware, suggest a way in which a manufacturer's joint can be constructed in a manner which will lend the box strength, with characteristics similar to those resulting in a stapled box construction, but which does not employ staples, and which is lower in cost to manufacture than either glued or taped constructions, and which is substantially stronger than the glued or taped constructions. Accordingly, a need has existed for a maximum strength, minimum cost, corrugated fiberboard box construction which may be manufactured by typical cutting, folding and box forming procedures, and which includes a lapped joint that eliminates the defects which have characterized the prior art.

SUMMARY OF THE INVENTION

Objectives of the invention include providing a new fiberboard box construction having a thread sewn lapped joint to provide a maximum strength, minimum cost joint wherein the joint strength of the box at least equals that of the prior stapled, lapped joint boxes formed of corrugated fiberboard and wherein the box manufacturing cost is less than that of either a stapled, glued, or taped box made of equivalent material, providing such new thread sewn manufacturer's joint boxes wherein the thread is sewn in such a fashion that all of the thread used to form the joint lies beneath the surface of the overlapping portions of the tab and panel to which the tab is joined, and providing a new corrugated fiberboard box manufacturer's joint construction which eliminates problems and satisfies needs that have existed in the art.

These and other objects and advantages may be obtained by the construction stated in general terms as a joint for a box of the manufacturer's type formed from a cut multiple panel fiberboard flat in which a panel edge portion at one end of the flat and a tab projecting from the other edge of the flat blank are overlapped, and wherein the improvements comprise sewing with a thread extending through and joining the overlapped panel edge and tab portions wherein the thread used to sew compresses the fiberboard and is entirely contained between and below the two exposed surfaces of the joined tab and panel portion.

BRIEF DESCRIPTION OF THE DRAWINGS

A preferred embodiment of the invention, illustrative of the best mode in which applicant has contemplated applying the principles, is set forth in the following description and shown in the drawings, and is particularly and distinctly pointed out and set forth in the appended claims.

In the drawings.

Similar numerals refer to similar parts throughout the various figures of the drawings.

DESCRIPTION OF THE PREFERRED EMBODIMENT

Figure 1:
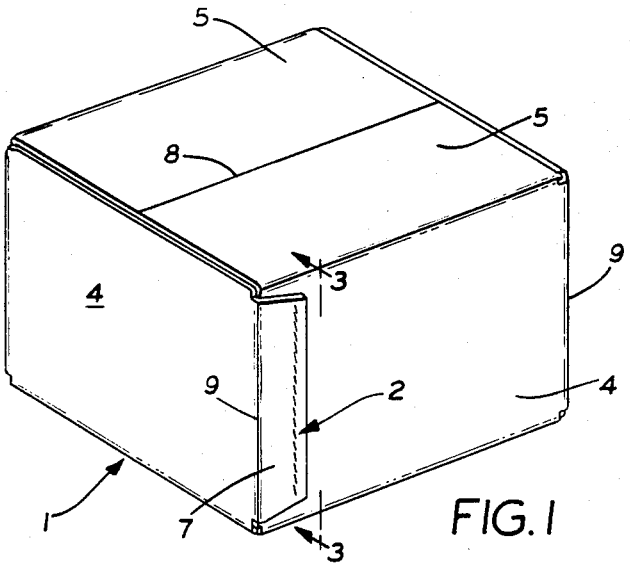
FIG. 1 is a perspective view showing a box with a manufacturer's joint including the new thread sewn manufacturer's joint at a corner of the box.
Figure 2:
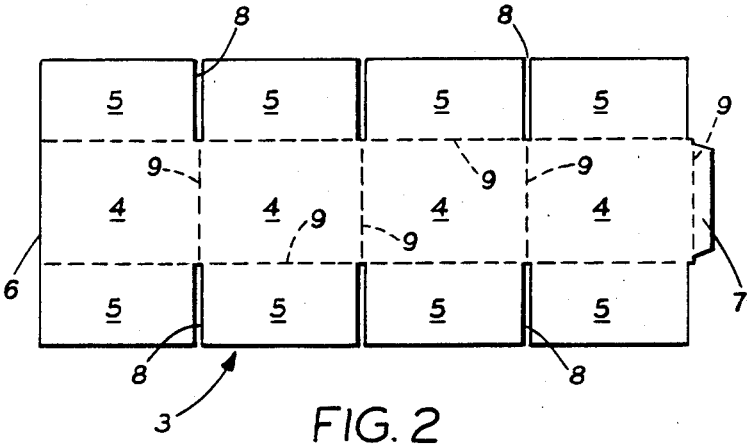
FIG. 2 is a plan view of a typical flat blank cut from a piece of fiberboard typically having four panels, upper and lower flaps and a tab at one end of the flat.
Figure 3:
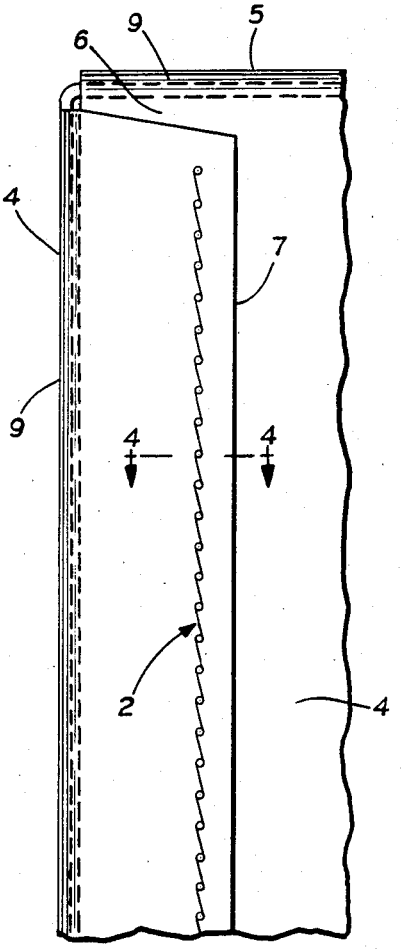
FIG. 3 is an enlarged fragmentary view of a corner portion of the box shown in FIG. 1.
Figure 4:
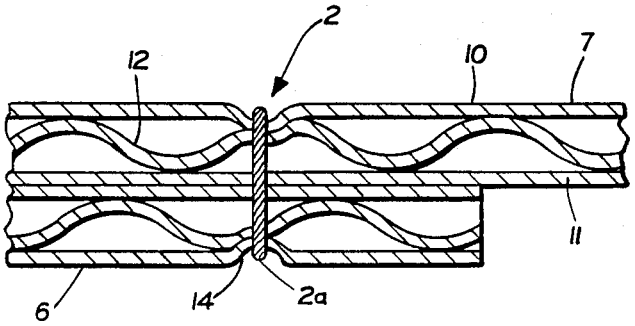
FIG. 4 is a fragmentary section view looking in the direction of the arrows 4—4, FIG. 3.

A typical fiberboard box, generally indicated at 1 in FIG. 1, is provided with a new thread sewn manufacturer's joint 2 of the invention, generally indicated at 2 in FIGS. 1, 3 and 4. The box 1 is preferably constructed from corrugated fiberboard material and includes a flat blank generally indicated at 3 in FIG. 2 which in accordance with usual box manufacturing procedures is cut from corrugated fiberboard and has multiple side panels 4 with flaps 5 at the top and bottom edges of the panels 4, a panel end edge 6 at one end of the flat 3, and a tab 7 projecting from the panel 4 at the other end of flat 3. In cutting the blanks which result in flats 3, slits 8 are formed between adjacent flaps 5, and fold lines 9 are formed between adjacent panels 4, between flaps 5 and panels 4, and between tab 7 and the panel 4 from which tab 7 projects.

These fold lines 9 enable the various portions of the flat 3 to be folded in a standard or typical manner to form box 1. In folding the flat 3 on fold lines 9 between panels 4 to begin the formation of the box, tab 7 is folded or lapped either over and under the panel edge portion 6. The panel portion 6 and tab 7 are sewn together, as shown in FIGS. 1, 3 and 4, to form the thread sewn manufacturer's joint 2 illustrated in enlarged fashion in FIGS. 4 and 5.

The fiberboard used, preferably corrugated fiberboard which is illustrated in the drawings, may have a thickness necessary to satisfy the bursting strength requirements for the box size and load or contents being packaged in the box. Various types of corrugated fiberboard, such as single, double wall thickness may be used, with a single wall thickness corrugated fiberboard being illustrated in FIG. 4.

The thread used for the thread sewn joint 2 may vary in type and strength, depending on the requirements of the joint to be formed, and these requirements are determined by the box size, fiberboard weight and thickness and bursting test values to be maintained in the finished box construction.

No. 4, 6 or 7 cord, plain or waxed or linen thread typically may be used for the thread sewn joint 2. Barbours beeswax Nylex No. 415 thread may also be used, as well as heavier or lighter grades thereof, depending on the strength characteristics desired, and other makes of threads having similar strengths may also be used.

Figure 5:
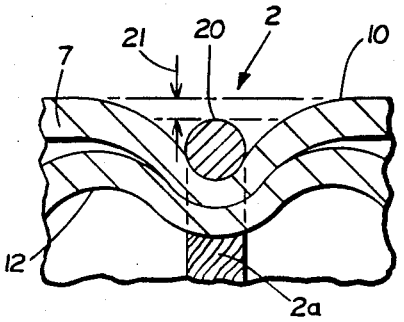
FIG. 5 is an enlarged fragmentary sectional view similar to FIG. 4 showing the relationship between the thread used to form the joint and one of the two surfaces of the opposite panels of the joint.

In forming the thread sewn joint 2, thread **2*a* is tensioned by the machine a sufficient amount so that the thread is completely embedded in the corrugated fiberboard, as shown in FIGS. 4 and 5. Referring to FIG. 4, a single wall corrugated fiberboard includes a first flat liner board 10, a second liner board 11, and a corrugating material 12. The outside surfaces of liner boards 10 and 11 will be spaced a distance apart from each other because of the thickness of the liner boards 10 and 11 as well as the space which results from the inclusion of the corrugating material 12** glued therebetween.

As the joint between flap 7 and end panel portion 6 is made by sewing, the tension of thread **2*a* crushes the liner board on the opposed faces of the overlapping tab 7 and end panel portion 6, as illustrated in FIG. 4 at 14. Crushing or collapsing, shown in very enlarged fashion in FIG. 5, results in the thread 2*a* of thread joint 2 being entirely disposed between the outer face of liner board 10 on both sides of the lapped joint. Further, the outwardmost portion 20 of thread 2*a* is spaced a distance below the plane of liner board 10, as indicated by arrows 21 in FIG. 5. The structure that results is such that all of the thread 2*a* used to form the joint 2 is disposed between and a distance from the outer faces of liner board 10** at the overlapped joint area. Thus, the thread is much less susceptible to being snagged or broken by any means, and the thread cannot mar or otherwise damage articles packaged in the box.

The thread sewn manufacturer's joint of the invention has a number of advantageous characteristics. It can provide a lapped joint known as a manufacturer's joint which is at least as strong as or stronger than a wire stapled lapped joint formed of equivalent fiberboard. The thread sewn lapped manufacturer's joint is less expensive to manufacture than the other types of lapped joints of the prior art formed from equivalent fiberboard material. Further, the thread sewn manufacturer's joint of the present invention is cleaner to manufacture than stapled, glued or taped box joints. Further, the use of thread sewn lapped joints permits the use of different colored threads which enables boxes to be coated according to the color of thread.

Accordingly, the new manufacturer's lapped joint construction of the present invention shown, described and claimed, and the advantageous features of high strength and low cost satisfies the stated objectives, overcomes problems and deficiencies of the prior art, and enables the elimination of high cost manufacturing procedures, and satisfies needs that have existed in the prior art, and provides improvements over constructions of the prior art.

In the foregoing description, certain terms have been used for brevity, clearness and understanding, but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details of the construction shown or described.

Having now described the features, discoveries and principles of the invention, the manner in which the improved box construction is constructed, assembled and operated, the characteristics of the new construction, and the advantageous, new and useful results obtained; the new and useful structures, devices, elements, arrangements, parts, and combinations are set forth in the appended claims.

I claim:

1. A joint for a box construction including (a) a foldable cut corrugated fiberboard flat having a plurality of side-by-side panels and opposite ends;

(b) one of said ends having an edge portion and the other end having a tab portion, (c) said tab and said edge portion each having a mating surface and an opposite exterior surface, (d) said flat being folded in box form with the tab overlapping the edge portion with the tab mating surface adjoining the edge portion mating surface, (e) sewn thread means extending through and between the exterior surfaces of the tab and edge portion and joining the tab to the edge portion, (f) said sewn thread means being completely embedded in the overlapping fiberboard and located below each of the exterior surfaces of the tab and edge portion.

* * * * *